US009695609B2

(12) United States Patent
Povzner et al.

(10) Patent No.: US 9,695,609 B2
(45) Date of Patent: Jul. 4, 2017

(54) METHOD AND APPARATUS TO PREVENT DIVER INJURY FROM HITTING THE DIVING PLATFORM AFTER COMMENCEMENT OF THE DIVE

(71) Applicants: Alexander Povzner, Vaughan (CA); Ilia Masliev, East Gwillimbury (CA); Olexandr Ryumshyn, Mississauga (CA)

(72) Inventors: Alexander Povzner, Vaughan (CA); Ilia Masliev, East Gwillimbury (CA); Olexandr Ryumshyn, Mississauga (CA)

( * ) Notice: Subject to any disclaimer, the term of this patent is extended or adjusted under 35 U.S.C. 154(b) by 253 days.

(21) Appl. No.: 14/584,801

(22) Filed: Dec. 29, 2014

(65) Prior Publication Data

US 2015/0184408 A1 Jul. 2, 2015

Related U.S. Application Data

(60) Provisional application No. 61/923,022, filed on Jan. 2, 2014.

(51) Int. Cl.

| | |
|---|---|
| ***E04H 4/00*** | (2006.01) |
| ***E04H 4/06*** | (2006.01) |
| ***A63B 5/10*** | (2006.01) |
| ***E04H 4/14*** | (2006.01) |
| ***A63B 71/00*** | (2006.01) |

(52) U.S. Cl.

CPC ..... *E04H 4/06* (2013.01); *A63B 5/10* (2013.01); *A63B 71/0054* (2013.01); *E04H 4/14* (2013.01); *A63B 2071/0063* (2013.01); *A63B 2220/801* (2013.01); *A63B 2225/20* (2013.01); *A63B 2225/50* (2013.01)

(58) Field of Classification Search

CPC ..... E04H 4/06; A63B 5/10; A63B 71/0054
USPC ..... 4/504
See application file for complete search history.

(56) References Cited

U.S. PATENT DOCUMENTS

| | | | | |
|---|---|---|---|---|
| 5,134,730 A * | 8/1992 | Vandis | ..... | E04H 4/14 248/345.1 |
| 5,423,093 A * | 6/1995 | Hall-Vandis | ..... | E04H 4/14 4/496 |
| 5,678,254 A * | 10/1997 | Jardim | ..... | B60R 13/04 4/504 |
| 7,114,200 B1 * | 10/2006 | Bennett | ..... | E04H 4/141 4/504 |

* cited by examiner

*Primary Examiner* — Huyen Le

(57) ABSTRACT

The invention's innovation in the field of safety of aquatic sport of platform diving is a method and apparatus to diminish the risk of the athlete's injury caused by an accidental collision with the platform after the take-off by timely activating a device that places a protective padding covering the top of the platform.

4 Claims, 13 Drawing Sheets

APPARATUS IN THE DEPLOYED STATE (ACTUAL SWIMMING POOL INSTALLATION)

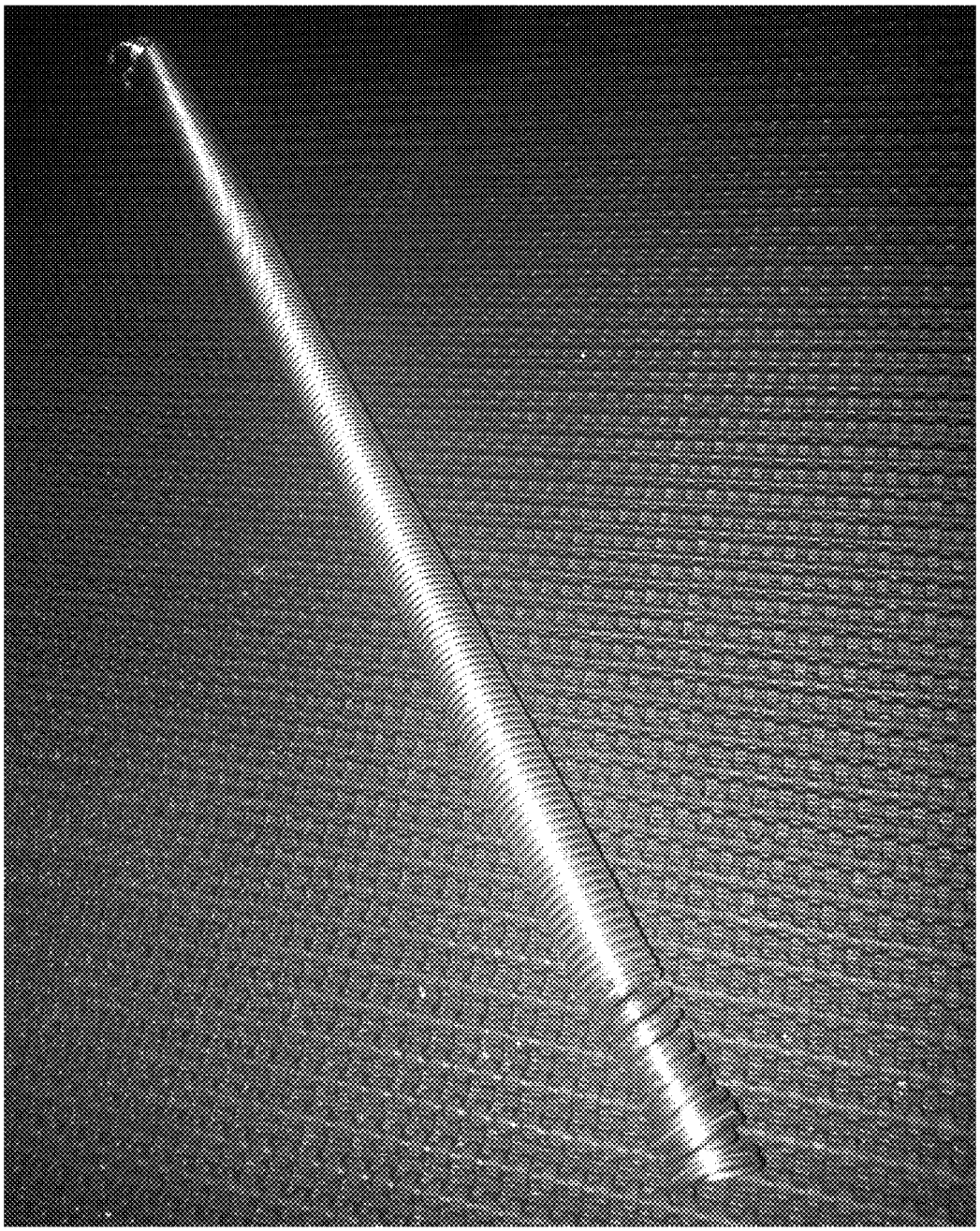
FIGURE 3. SPRING COIL (DISASSEMBLED FROM THE APPARATUS)

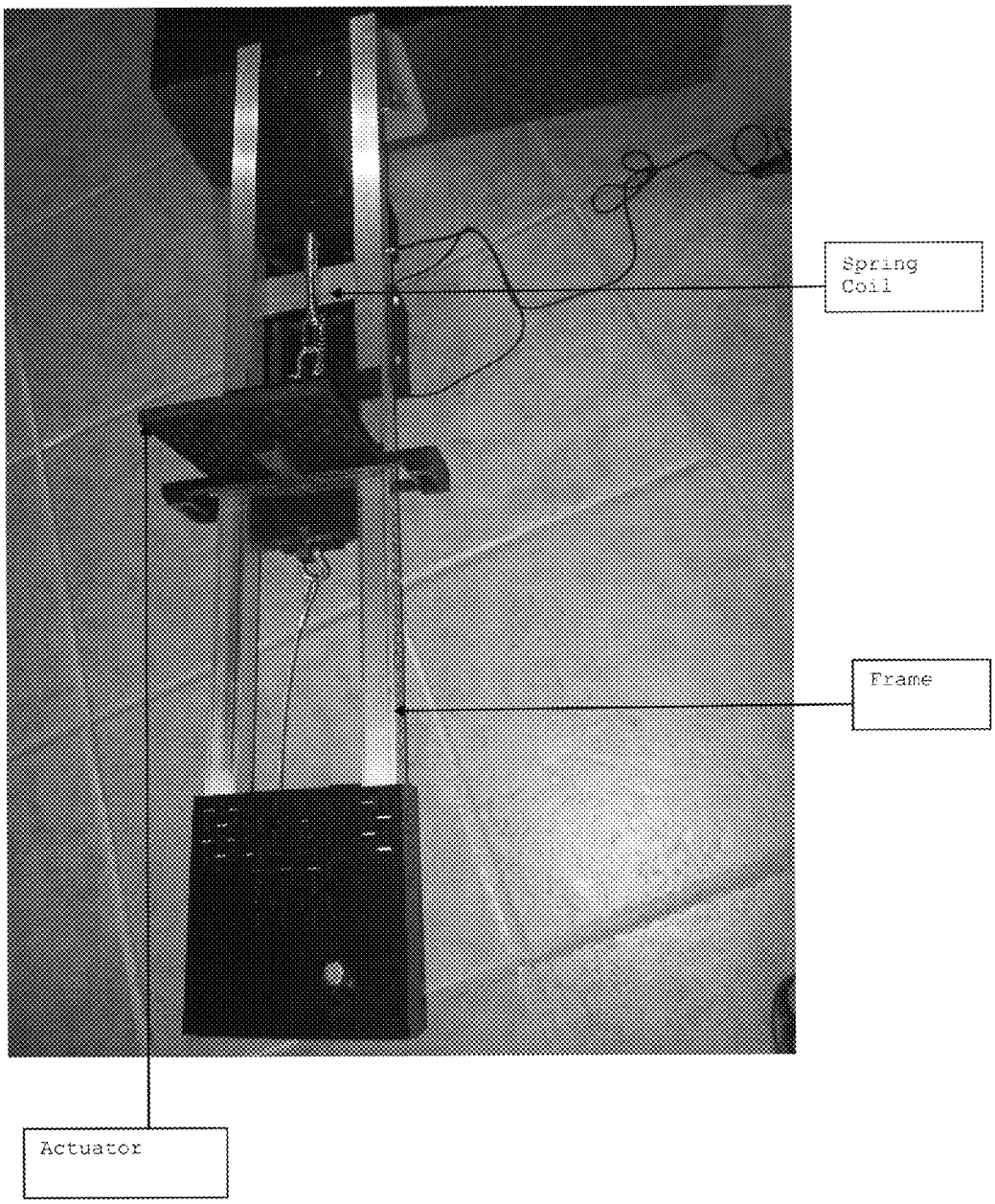
FIGURE 4. ASSEMBLED FRAME SHOWING ACTUATOR AND SPRING COIL (PADDING REMOVED).

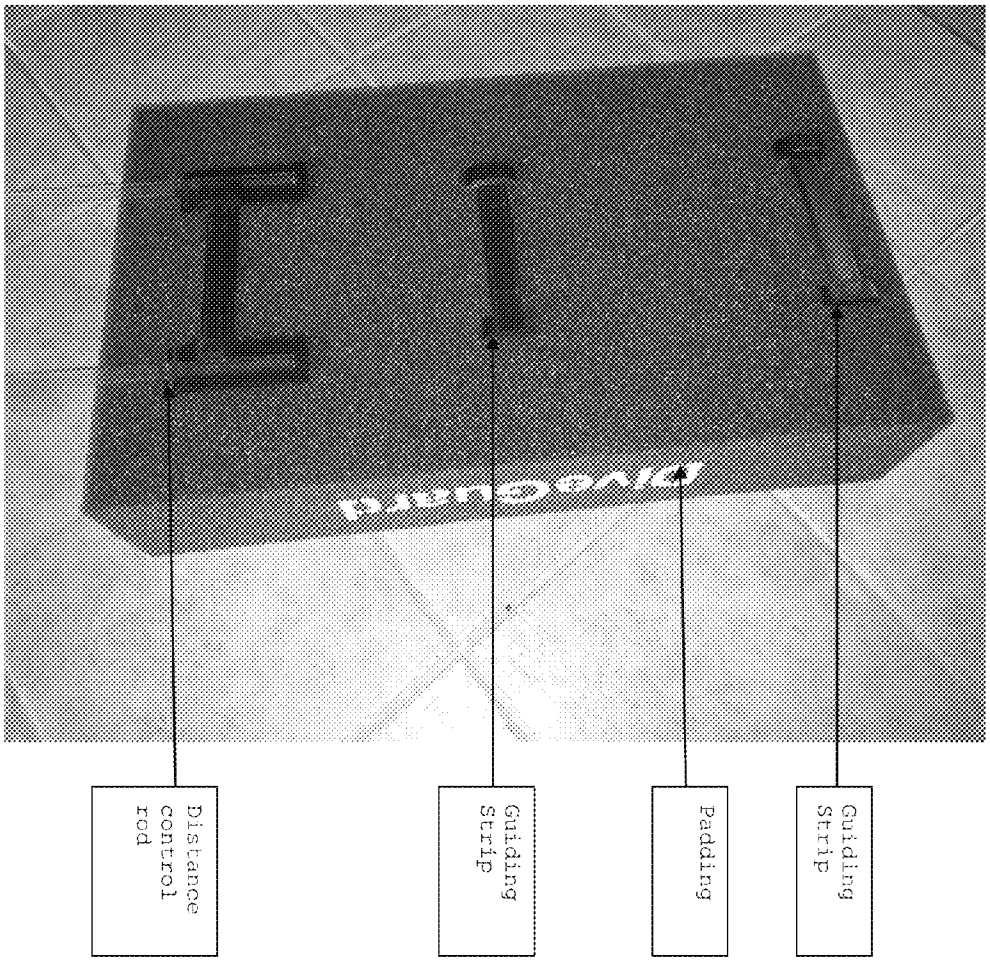
FIGURE 5. PADDING WITH GUIDING STRIPS AND DISTANCE CONTROL RODS ATTACHED

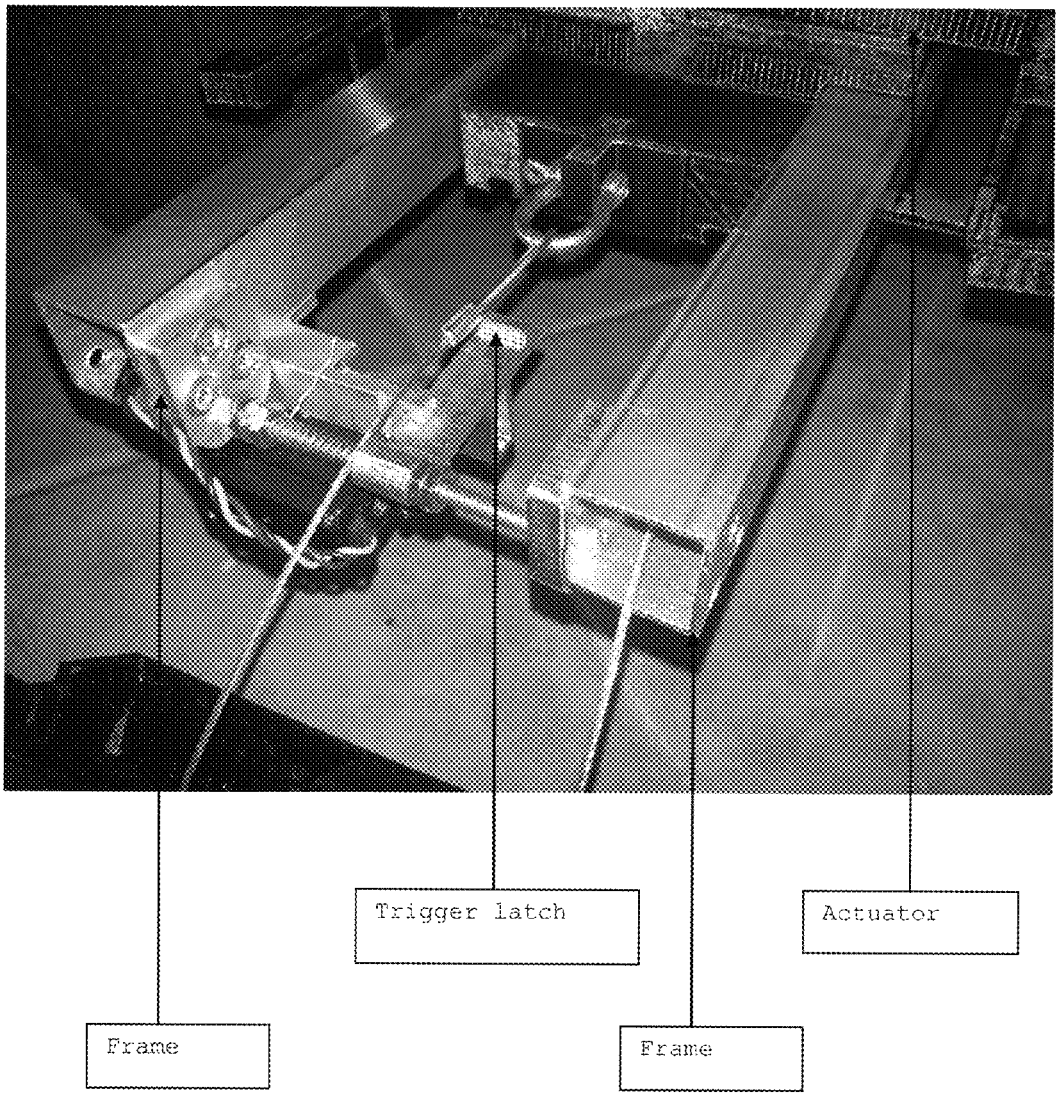
FIGURE 6. PART OF FRAME SHOWING TRIGGER AND ACTUATOR

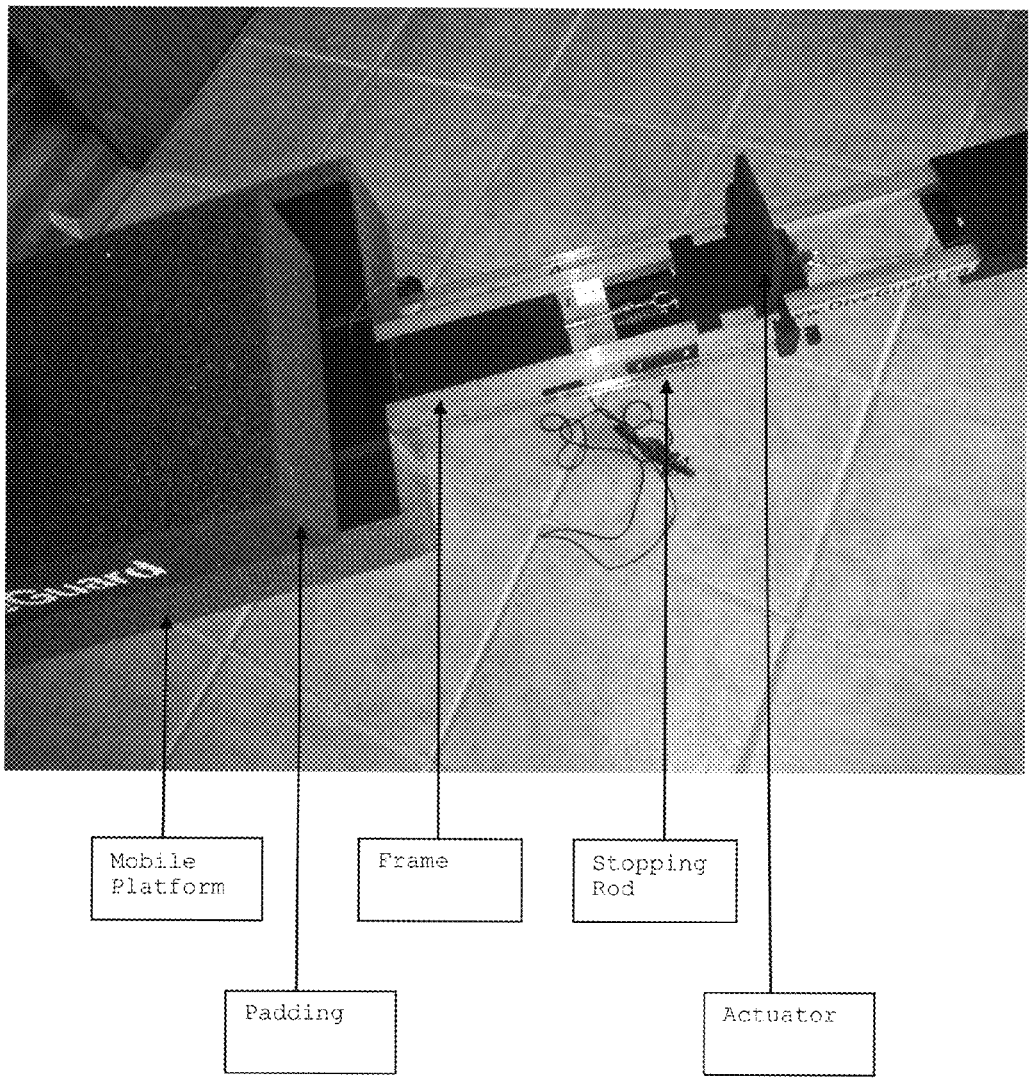
FIGURE 7. APPARATUS (MOBILE VERSION), PARTS IDENTIFIED

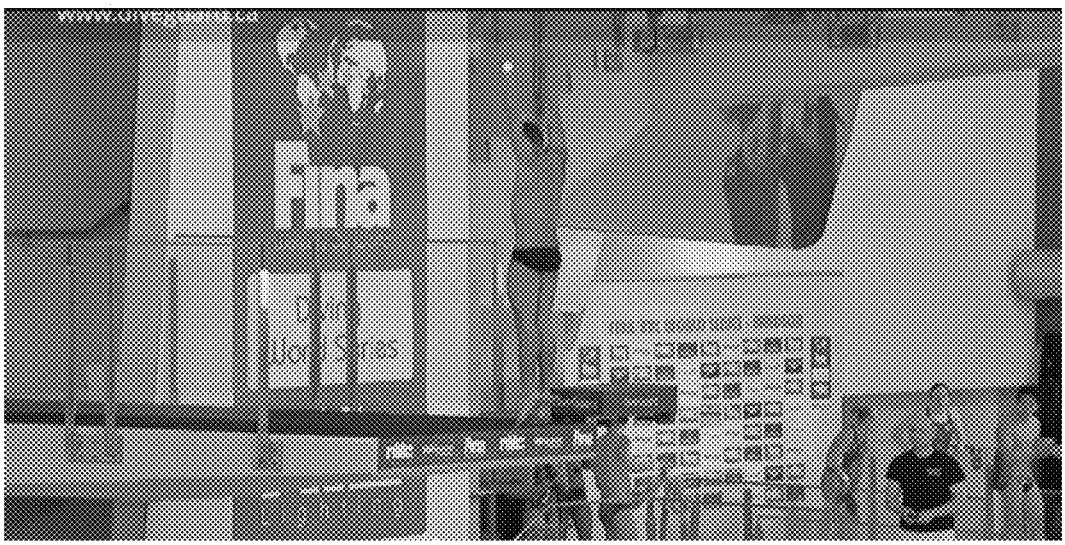
FIGURE 8. APPARATUS IN THE LOADED STATE PRIOR TO DIVER TAKE-OFF (FRONT VIEW - ACTUAL SWIMMING POOL INSTALLATION)
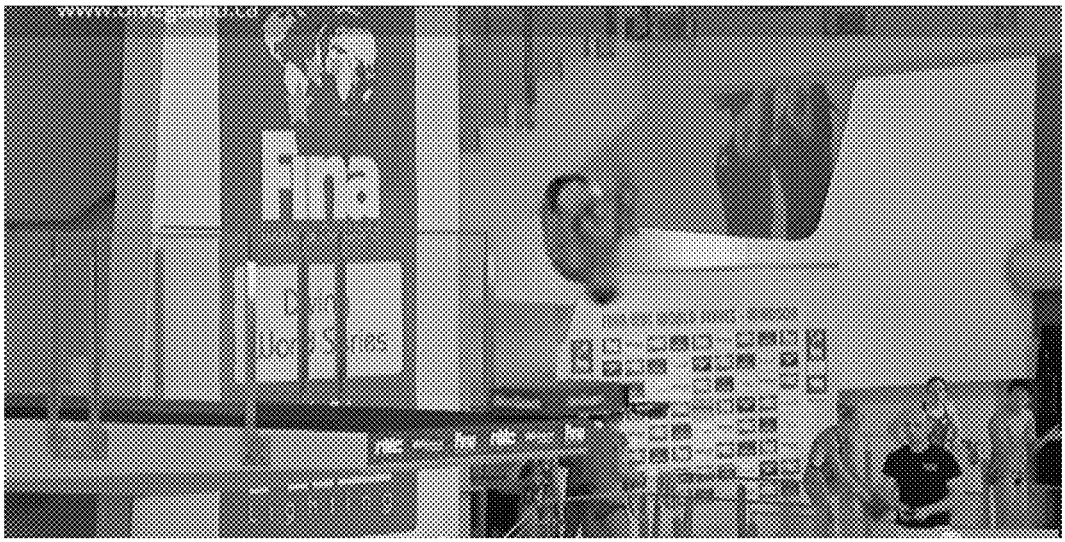
FIGURE 9. APPARATUS IN THE PROCESS OF DEPLOYMENT (FRONT VIEW - ACTUAL SWIMMING POOL INSTALLATION)

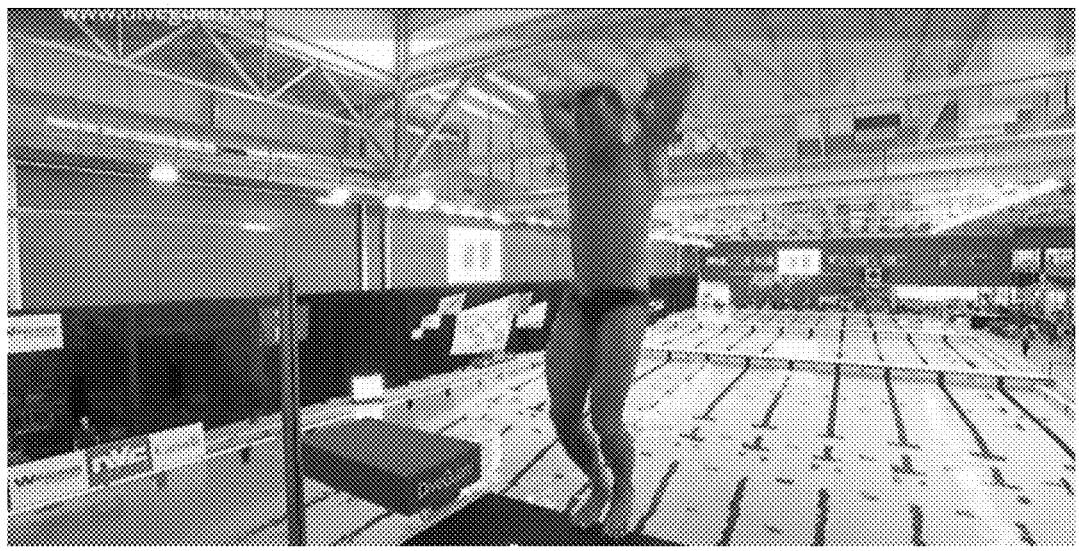
FIGURE 10. APPARATUS IN THE LOADED STATE PRIOR TO DIVER TAKE-OFF (BACK VIEW - ACTUAL SWIMMING POOL INSTALLATION)
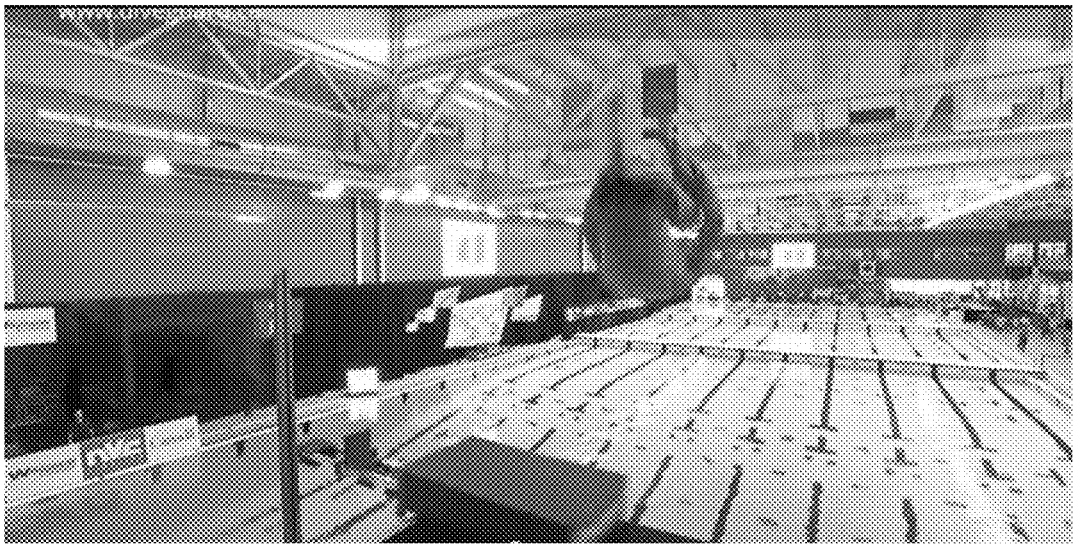
FIGURE 11. APPARATUS IN THE PROCESS OF DEPLOYMENT (BACK VIEW - ACTUAL SWIMMING POOL INSTALLATION)

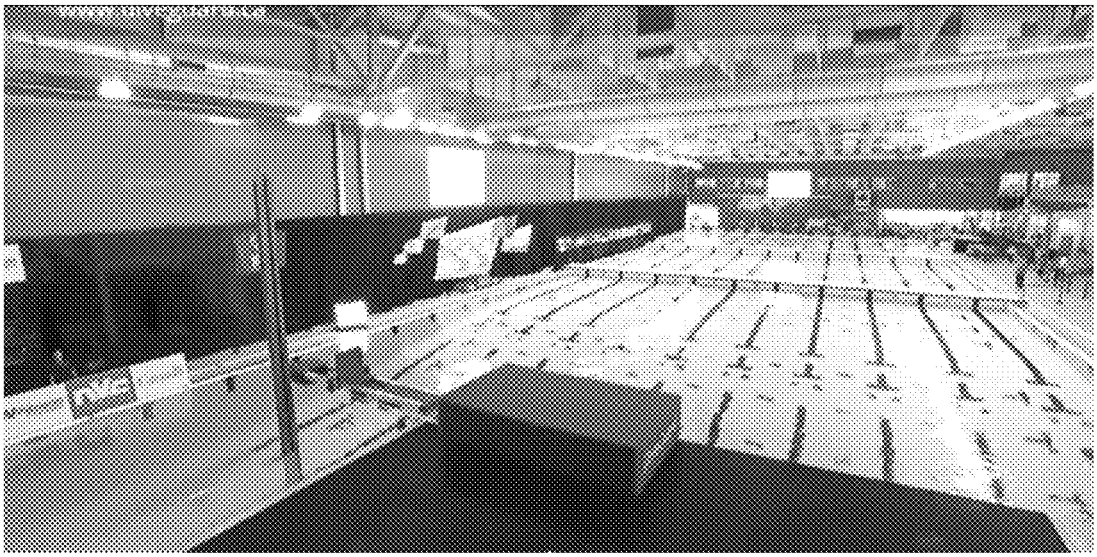
FIGURE 12. APPARATUS IN THE DEPLOYED STATE (ACTUAL SWIMMING POOL INSTALLATION)

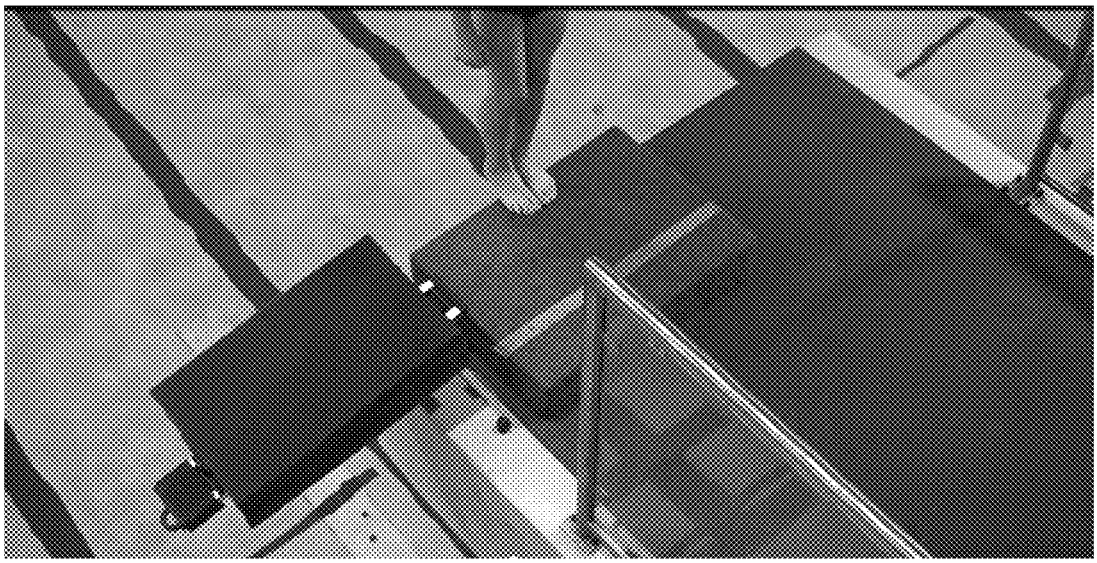
FIGURE 13. APPARATUS (MOBILE VERSION) PRIOR TO DIVER TAKE-OFF

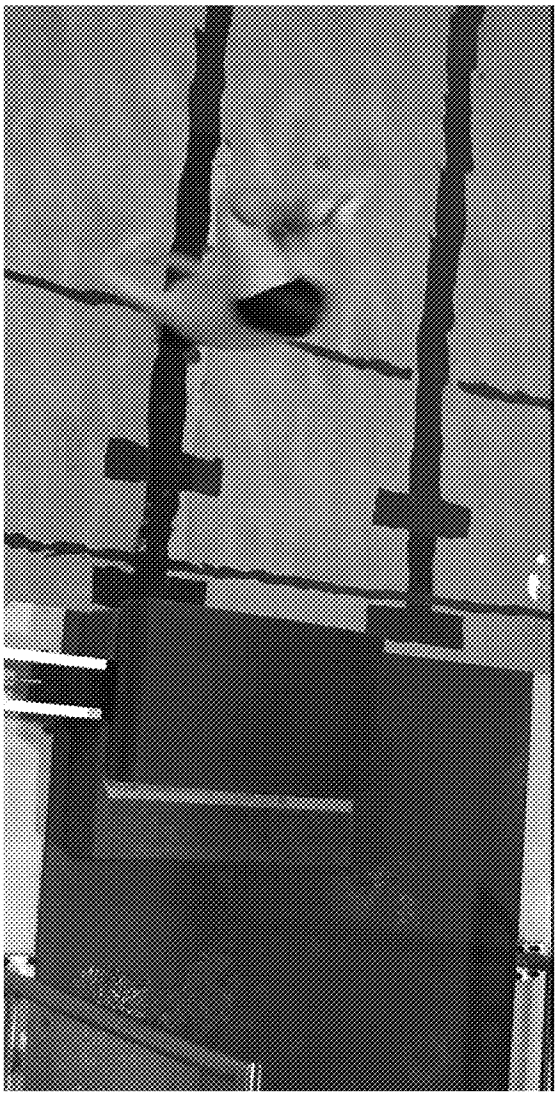
FIGURE 14. APPARATUS (MOBILE VERSION) IN THE DEPLOYED STATE

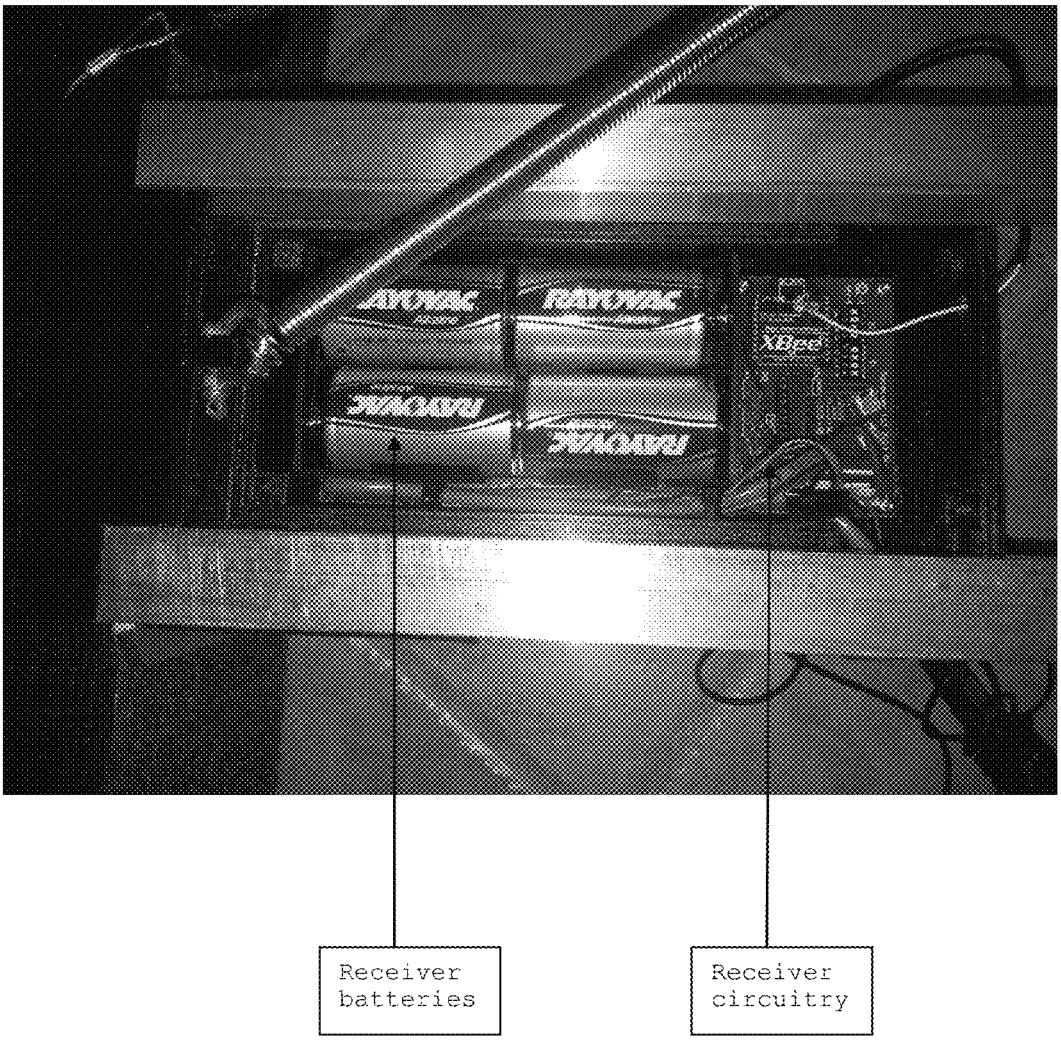
FIGURE 15. RECEIVER

METHOD AND APPARATUS TO PREVENT DIVER INJURY FROM HITTING THE DIVING PLATFORM AFTER COMMENCEMENT OF THE DIVE

RELATED PATENT APPLICATIONS

This invention is a non-provisional patent application based on the previously filed Provisional application of the same name and the same Inventors:

Provisional patent filed to US PTO on 2 Jan. 2014 No. 61/923,022.

BACKGROUND OF THE INVENTION

The invention is a safety device used to prevent a practitioner of an aquatic sport of platform diving from injury caused by unanticipated or unwanted contact with a part of the platform after clearing the surface of the platform and commencing the inertial phase of the dive or another skill.

In the sport of platform diving, after commencement of the dive, the athlete is in free fall movement and has limited control of the dive trajectory. A miscalculation on the part of the athlete (resulting for instance in insufficient horizontal speed away from the platform at the moment of the take-off) can result in a part of the athlete's body coming into unwanted or unanticipated contact with the platform. Such contact may result in an injury to the body of the athlete.

A method and apparatus of preventing altogether or reducing the severity of the injury to the athlete's body in the above described situation is invented and described in this patent application.

BRIEF SUMMARY OF THE INVENTION

The method of injury prevention is to deploy a padding made of soft protective material between the platform and the athlete's body after the takes-off. Should the athlete's trajectory accidentally intersect with the platform after the take-off (for instance due to miscalculation on the part of the athlete), the deployed padding would partially absorb the shock of the collision between the platform and the athlete's body and spread the impact force along the padding's thickness. After the initial contact of the athlete with the padding is made, the padding starts to compress and generate a gradually increasing stopping force that reduces the peak acceleration of the athlete's body and diminishes the risk of scratches, bruises, fractures, concussions, or other injuries to the athlete's body that could have resulted from collision with unprotected surface of the platform. The padding is deployed through the use of the described and claimed apparatus.

Figure 1:
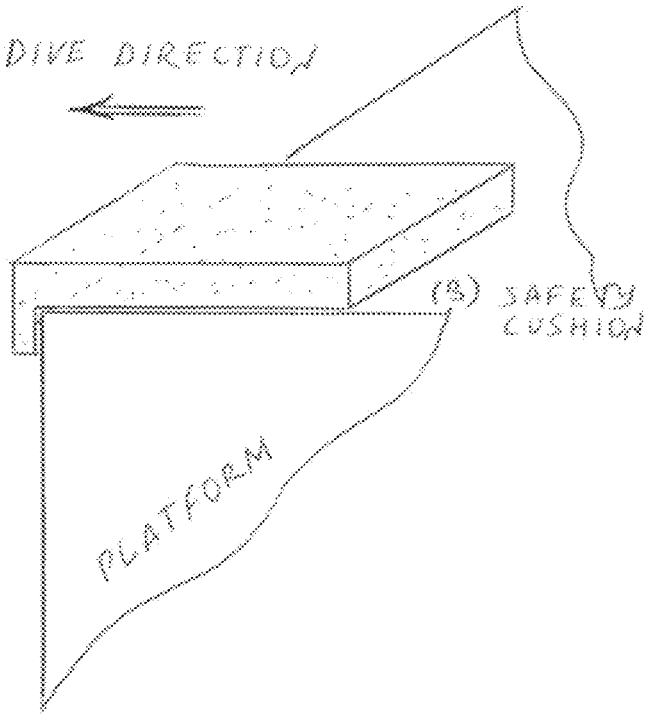
FIG. 1. DIVING PLATFORM WITH DEPLOYED PADDING
Figure 2:
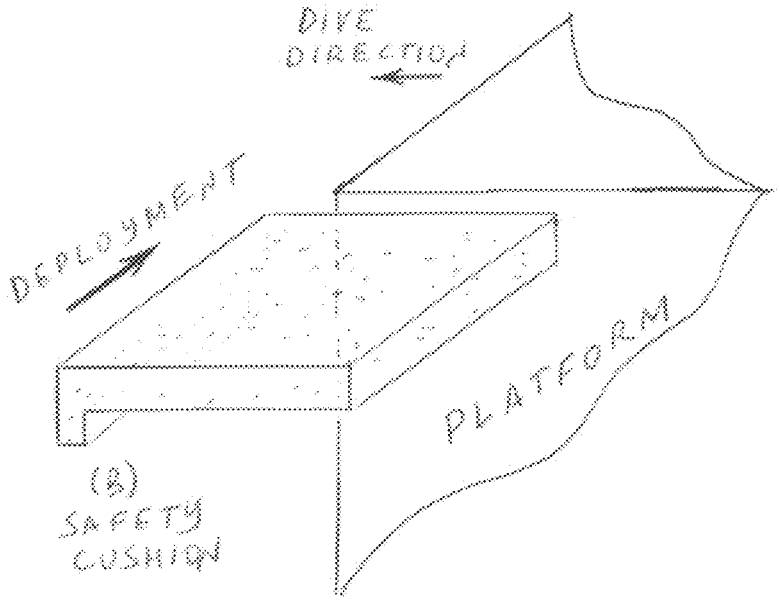

Showing the platform and the padding deployed to cover the top and forward part of the platform after commencement of the dive.

FIG. 2. DIVING PLATFORM (PADDING NOT DEPLOYED)

Showing the platform and the padding position prior to deployment. In this illustration it can be seen that prior to deployment the padding is off the platform and is not hindering the use of the platform surface during preparation and commencement of the dive.

FIG. 3. SPRING COIL (DISASSEMBLED FROM THE APPARATUS)

The spring coil is used as the force source in the embodiment of the invention, shown separately from the frame.

FIG. 4. ASSEMBLED FRAME SHOWING ACTUATOR AND SPRING COIL (PADDING REMOVED).

The illustration is showing the frame with spring coil and actuator installed. Padding is not shown (it is placed on top of the frame).

FIG. 5. PADDING WITH GUIDING STRIPS AND DISTANCE CONTROL RODS ATTACHED

The padding assembly with guiding strips and distance control rods, shown upside down.

FIG. 6. PART OF FRAME SHOWING TRIGGER AND ACTUATOR

The illustration shows part of the frame furthest from the platform and the trigger latch (machined from aluminum block). In the deployed position the latch prevents the actuator from being pulled toward the platform by the spring.

FIG. 7. APPARATUS (MOBILE VERSION), PARTS IDENTIFIED

The illustration shows the assembled apparatus installed on the mobile platform. The padding is in deployed position. Some of the major parts of the apparatus are identified.

FIG. 8. APPARATUS IN THE LOADED STATE PRIOR TO DIVER TAKE-OFF (FRONT VIEW—ACTUAL SWIMMING POOL INSTALLATION)

Illustration showing actual swimming pool installation of the invention prior to diver take-off, shot from the front of the platform.

FIG. 9. APPARATUS IN THE PROCESS OF DEPLOYMENT (FRONT VIEW—ACTUAL SWIMMING POOL INSTALLATION)

Illustration showing actual swimming pool installation of the invention after diver take-off, shot from the front of the platform.

FIG. 10. APPARATUS IN THE LOADED STATE PRIOR TO DIVER TAKE-OFF (BACK VIEW—ACTUAL SWIMMING POOL INSTALLATION)

Same as FIG. 8, shot from the back of the platform

FIG. 11. APPARATUS IN THE PROCESS OF DEPLOYMENT (BACK VIEW—ACTUAL SWIMMING POOL INSTALLATION)

Same as FIG. 9, shot from the back of the platform

FIG. 12. APPARATUS IN THE DEPLOYED STATE (ACTUAL SWIMMING POOL INSTALLATION)

Actual swimming pool installation shot from the back of the platform after deployment.

FIG. 13. APPARATUS (MOBILE VERSION) PRIOR TO DIVER TAKE-OFF

The diver is standing on the mobile platform in preparation to the take-off. The apparatus is in the loaded state.

FIG. 14. APPARATUS (MOBILE VERSION) IN THE DEPLOYED STATE

The apparatus (mobile version) is deployed. The diver has taken off from the mobile platform.

FIG. 15. RECEIVER

The receiver is a part of control device intended to receive control signal from the transmitter and initiate the deployment. The illustration shows the receiver circuitry board and the battery pack that powers the receiver.

DETAILED DESCRIPTION OF THE INVENTION

The injury prevention apparatus (the invention) has two distinct states, "loaded" and "deployed".

In the "loaded" state (FIGS. 2, 8, 10, 13) the padding resides on the apparatus frame. In the embodiment of the invention the apparatus is mounted off the platform, not hindering in any way the athlete's use of the platform surface for the purpose of performing the preparation to the dive and the dive itself. In the second state, deployed (FIGS. 1, 12, 14), the apparatus engages so that the top surface of the platform is covered with protective padding. The material of the padding (FIG. 5, 7) in the described embodiment is reticulated polyurethane foam, but other materials can be used as well that provide the same impact-adsorption properties, including natural or synthetic fibres.

In the "deployed" state (FIG. 1, 12, 14) the padding covers the top and (partially) front platform surface and is ready to cushion the impact resulting from an accidental collision of the athlete with the platform. In order to deploy the apparatus (to transition from state "loaded" to state "deployed", FIGS. 11, 9) the padding material is moved from its loaded position on top of the frame to the top surface of the platform by an application of a mechanical force to the padding. In the described embodiment of the invention the mechanical force for deployment is generated by a stretched coiled spring (FIGS. 3, 4). The force can be provided by a number of other means, including (but not exclusively) by an electric motor, electric magnet/solenoid, a pneumatic device, or other source of mechanical energy.

To minimize the disturbance to the athlete during the diving procedure prior to the take-off, the embodiment of the invention keeps the padding on the apparatus frame in the "loaded" state. The frame is securely fastened to the platform side with the mounting system consisting of a steel plate attached to the platform with stainless steel screws. The mounting system allows for quick detachment of the apparatus from the platform for inspection, repairs, or for storage when not in use. The mounting system is not considered a major part of the invention.

To increase the speed and accuracy of the deployment, the embodiment of the invention uses guiding strips and a set of distance control rods (stopping rods) attached to the padding that improve the directional accuracy of the deployment and control the distance of travel of the padding along the platform during the deployment (FIGS. 5, 7). The guiding strips serve the additional purpose of reduction of the friction between the platform and the padding, thus increasing deployment speed and reducing the padding material wear and tear. The stopping rods prevent the padding from moving more than a set distance along the frame during deployment. Other variants of the apparatus may use other mechanisms to control the deployment distance, such as wire, thread, or rods in different configurations, or not use any distance control mechanism at all, relying on the regulation of the applied mechanical force and friction to set the padding deployment position. Likewise, other variants of the invention may have guiding strips of a different kind, or not have them at all. These additional elements are not considered as a major part of the invention.

Even though it is envisioned that in the majority of cases the apparatus will be attached directly to the platform side (at the 90% angle to the direction of the dive, FIG. 1), there is a variant of the apparatus construction where the frame is attached to a mobile platform made for instance of wood (FIGS. 7, 13, 14). In the mobile variant the platform itself does not need to be modified to permanently install the apparatus. Instead the apparatus attached to the mobile platform is simply placed on the surface of the platform (FIGS. 13, 14). The diver using the apparatus has to then launch him/herself from the mobile platform as opposed to launching from the platform surface directly (FIG. 13). Both installation versions (mobile and installed on the platform) are covered by the invention claims.

The apparatus has the following material parts, given in the following list together with their respected embodiments as constructed by the inventors:

(1) Padding

The soft protective padding made of material having thickness and indentation load deflection (ILD) that is sufficient to absorb and cushion mechanical forces arising from the possible contact of the athlete with the springboard and reduce the peak accelerations of the diver's body parts caused by such contact.

In the concrete embodiment of the invention the padding (FIGS. 5, 7) is cut as a solid block of reticulated polyurethane foam fitted with guiding strips and a couple of distance control rods (stopping rods) to improve the accuracy of deployment both in terms of deployment direction, deployment speed, and final position of the padding on the platform. The guiding strips (FIG. 5) allow the padding to slide along the rails during deployment and reduce the friction between the padding and the platform when the padding moves onto the platform. The distance control rods (FIGS. 5, 7) cause the padding to stop at a precise position on the platform: when the padding is moved along the frame and onto the platform as far as the stopping rods allow it, the padding is stopped because distance control rods cannot move through the opening in the frame past the set distance (FIG. 7)

The concrete shape of the padding (concrete block of polyurethane) or the additional position control devices (stopping rods and guiding strips) are not claimed as major feature of the invention. Other shapes of padding are possible as well as other improvements or modifications that increase accuracy of deployment of the padding on the platform.

(2) Force Source

The force source is the component that generates the mechanical force that causes the padding to move onto the springboard surface during deployment. In the embodiment of the invention the force source is a coil spring (FIGS. 3, 4) that is manually stretched (loaded) prior to deployment.

Other variants of the invention may use a linear (stepper) electric motor, pneumatic component, linear electromagnetic solenoid, rotational electric motor, or other force source. The particular source of mechanical energy chosen by the implementer is not considered to be a major differentiating feature.

(3) Actuator

The actuator is the part of apparatus that transmits the mechanical force generated by the force source to the padding to cause it to be deployed. The embodiment uses a plastic shuttle with a pusher plate that freely moves along the frame tubes. The pusher plate attached to the shuttle pushes the padding along the frame and onto the diving platform itself (FIGS. 4, 6, 7). The actuator is affixed to the spring coil (the force source) and thus release of the previously stretched coil causes the actuator to push the padding along the frame and the apparatus to be deployed. The particular actuator design is not considered to be a distinguishing feature of the implementation.

(4) Frame

The frame is the part that holds together the major components of the apparatus, providing the means of mechanical stability to the assembly and allowing the apparatus to be firmly connected to the platform. The embodiment of the invention uses an aluminum frame made of two aluminum square tubes (FIGS. 4, 6, 7). One of the frame functions is to limit the movement of the actuator to just one dimension, perpendicular to the front of the diving platform.

The particular details of the frame construction is not considered to be a major feature of the invention.

(5) Control Device

The control device is the element of the apparatus that initiates the deployment process. In the embodiment of the invention, the control device further consists of a) a trigger machined from aluminum as a catch or latch (FIG. 6) that holds the actuator in a fixed position prior to deployment and thus prevents the stretched spring coil release prior to the moment of deployment;

b) a miniature electric servo motor (not shown in the drawings) connected to the trigger with a swivel arm that provides effort necessary to release the trigger at the moment of deployment;

c) remote radio receiver powered by an electrical battery pack (FIG. 15) that upon detecting release signal, provides power to the electric motor;

d) remote radio transmitter (not shown in the drawings) that generates and transmits the release signal to the receiver.

In the embodiment of the invention the deployment is controlled by a radio transmitter (d) operated by the person supervising the dive such as a diving coach or diving instructor. The corresponding receiver is installed on the frame (FIG. 15) and upon receiving the signal emitted by the transmitter causes the control signal to be sent to the servo motor (b). The mechanical force generated by the servo motor is transmitted to the trigger latch (FIG. 6) via the swivel arm. The trigger latch is lifted, releasing the previously stretched coil. The coil contracts and transmits the stored mechanical energy to the actuator. The actuator pushes the padding along the frame, causing it to be deployed.

The exact deployment moment is decided by the dive coach or instructor. By observing the dive the coach can make a judgement call that the diver has taken off (FIGS. 9, 11, 14), at which time the coach will activate the described apparatus by pushing corresponding button on the remote transmitter (d). In other embodiments the deployment can be triggered mechanically with a piece of string, electrically via attached wires, or by any other means suitable to transmit the signal to the apparatus.

In addition to the triggering the deployment manually, the deployment can be triggered by an automatic sensor including, but not exclusively, by an accelerometer device placed on the body of the diver, by a photoelectric or laser sensor, by a video camera fitted with image recognition, or by other automatic means without invalidating the claim. We claim that particular means of timely triggering the deployment of the device to be a minor feature of the invention.

The invention claimed is:

1. An apparatus protecting the diver from serious injury resulting from collision with the diving platform, enabling the diver to take off from an unaltered platform surface, comprising:

- a protective padding that fully or partially covers the platform surface after commencement of the dive;
- a deployment mechanism that enables placement of the said padding on a specific part of the platform surface where risk of collision with diver exists;
- a frame to house the deployment mechanism with means for attachment of the deployment mechanism to the platform;
- a control device to trigger the deployment of the protective padding from a location other than that on the diving platform, such as from the pool deck.

2. A protective padding of claim 1, for example composed of lightweight porous material such as reticulated polyurethane foam.

3. A deployment mechanism of claim 1 to effect placement of the protective padding onto the part of the platform surface to be protected by means of creating or releasing a mechanical force applied to the protective padding at the moment of deployment and imparting to it a sufficient linear (as opposed to angular) velocity directed predominantly in the horizontal plane to minimize the effect of the protective padding's moment of inertia, and utilizing for deployment an energy source other than human muscle power, selected from a group consisting of electric, pneumatic, or stored mechanical energy.

4. A control mechanism of claim 1 serving as means to trigger the deployment mechanism by means of transmitting a communication signal to the deployment mechanism.

* * * * *